US009114453B2

(12) United States Patent
Shan et al.

(10) Patent No.: US 9,114,453 B2
(45) Date of Patent: Aug. 25, 2015

(54) FORMING MACHINE WITHOUT PATTERN CASTING

(75) Inventors: Zhongde Shan, Beijing (CN); Feng Liu, Beijing (CN); Limin Liu, Beijing (CN); Xiwen Li, Beijing (CN); Shaokai Chen, Beijing (CN)

(73) Assignee: Advanced Manufacture Technology Center, China Academy Of Machinery Science & Technology, Beijing (CN)

( * ) Notice: Subject to any disclaimer, the term of this patent is extended or adjusted under 35 U.S.C. 154(b) by 107 days.

(21) Appl. No.: 13/880,664

(22) PCT Filed: May 18, 2011

(86) PCT No.: PCT/CN2011/074277
§ 371 (c)(1), (2), (4) Date: Apr. 19, 2013

(87) PCT Pub. No.: WO2012/155348
PCT Pub. Date: Nov. 22, 2012

(65) Prior Publication Data

US 2013/0240169 A1 Sep. 19, 2013

(30) Foreign Application Priority Data

May 17, 2011 (CN) ..... 2011 1 0127890

(51) Int. Cl.
*B22C 11/00* (2006.01)
*B22C 19/02* (2006.01)
(Continued)

(52) U.S. Cl.
CPC . *B22C 11/00* (2013.01); *B22C 9/02* (2013.01); *B22C 19/02* (2013.01); *B22C 23/00* (2013.01)

(58) Field of Classification Search
CPC ..... B22C 11/00; B22C 19/02; B22C 9/02; B22C 23/00
USPC ..... 164/159, 161, 17; 269/310, 269/289 R–289 MR
See application file for complete search history.

(56) References Cited

U.S. PATENT DOCUMENTS 4,907,337 A * 3/1990 Krusi ..... 483/55
6,651,308 B2 * 11/2003 Oldani ..... 29/558
(Continued)

FOREIGN PATENT DOCUMENTS

CN 85103880 A 11/1986
CN 101279357 10/2008
(Continued)

OTHER PUBLICATIONS

International Search Report (Form PCT/ISA/210) for PCT/CN2011/074277, mailed Mar. 1, 2012.

*Primary Examiner* — Kevin P Kerns
*Assistant Examiner* — Steven Ha
(74) *Attorney, Agent, or Firm* — Koppel, Patrick, Heybl & Philpott

(57) ABSTRACT

The disclosure provides a containerless casting forming machine, including: a multi-axis motion system which at least includes an X-axis motion system, a Y-axis motion system and a Z-axis motion system, and a workbench which is below the multi-axis motion system; and further includes: a moving platform system below the workbench, including a moving bracket which can reciprocate along the direction parallel to the X axis, a lifting device provided on the moving bracket, which is used for lifting and supporting the workbench to enable the linkage between the workbench and the moving bracket. The containerless casting forming machine of the disclosure can move the workbench without a lifting tool, and machine a casting mold with a large size and a complex cavity, and causes little pollution to the environment.

11 Claims, 7 Drawing Sheets

(51) Int. Cl.
*B22C 9/02* (2006.01)
*B22C 23/00* (2006.01)

(56) References Cited

U.S. PATENT DOCUMENTS

2009/0140482 A1* 6/2009 Saberton et al. ..... 269/296
2010/0194013 A1* 8/2010 Hall et al. ..... 269/56
2011/0230993 A1* 9/2011 Shan et al. ..... 700/98

FOREIGN PATENT DOCUMENTS

CN 201350492 Y 11/2009
JP 9-234543 A 9/1997
WO WO03/090951 A1 11/2003
WO WO 2010075716 A1 * 7/2010

* cited by examiner

FORMING MACHINE WITHOUT PATTERN CASTING

FIELD OF THE INVENTION

The disclosure relates to the field of machining, more specifically, to a containerless casting forming machine.

BACKGROUND OF THE INVENTION

To solve the problems of long manufacturing cycle, high production cost and large resource consumption in the conventional casting manufacturing process, the dieless casting numerical control machining and forming technology emerges as the times require, which is the systematic integration of the Computer Aided Design (CAD) technology, casting technology, numerical control technology, cutting technology and other technologies, and is also a brand new fast casting forming technology. The containerless casting forming machine adopting such technologies can manufacture casting sand molds of various shapes without a die and provide a new carrier for the single and small-scale trial production of castings. Use of the equipment can shorten the production cycle and improve the productivity, and is particularly suitable for the machining of casting molds with large size, small scale and complex shape.

The containerless casting forming machine includes a main part which contains a multi-axis (three axes or more) motion system, a special use sand mold cutter and a sand discharging system, and a special use control software which is matched with a sand mold cutting process; and the technology and the equipment have been successfully applied to the trial production process of the sample casting molds of new products, such as an engine. However, the containerless casting forming machine in the prior art needs a special lifting tool to move its workbench bearing a sand blank for placing the sand blank to be machined and removing the machined casting sand mold. However, when the lifting tool is used to move the workbench, the operation process is complex and the movement of the workbench is inconvenient. In addition, at present, there has been very little research on the casting mold obtained by directly machining the sand mold via the numerical control cutting equipment, and the casting mold numerical control cutting and forming machine for cutting the sand blank (patent number: CN200714010705.1) cannot machine the casting molds of large complex casting, which has large size structure, complex curved surface of casting mold cavity and a difficult process. Moreover, the equipment has the problems of sand cutting dispersion and difficult maintenance of the motion system, and further causes serious dust pollution in the workshop, so that workers work in a severe environment.

SUMMARY OF THE INVENTION

The purpose of disclosure is to provide a containerless casting forming machine, to solve the problem that the moving process of the workbench is complex and inconvenient because the workbench in the containerless casting forming machine in the prior art is moved by a special lifting tool. Furthermore, the containerless casting forming machine provided by the disclosure can further solve the problem that the containerless casting forming machine in the prior art cannot machine the casting mold of large complex casting, which has large size structure, complex curved surface of casting mold cavity and a difficult process.

In one aspect, the disclosure provides a containerless casting forming machine including: a multi-axis motion system, which at least includes an X-axis motion system, a Y-axis motion system and a Z-axis motion system, and a workbench, which is below the multi-axis motion system, wherein the containerless casting forming machine further includes: a moving platform system below the workbench, including a moving bracket which can reciprocate along the direction parallel to the X axis, a lifting device provided on the moving bracket, which is used for lifting and supporting the workbench to enable the linkage between the workbench and the moving bracket.

Furthermore, the X-axis motion system includes a first X-axis motion system and a second X-axis motion system which are parallel to each other; the first X-axis motion system is supported by a first bracket, the second X-axis motion system is supported by a second bracket, and there is a predetermined distance between the first bracket and the second bracket; both ends of the Y-axis motion system are slidably matched with the first X-axis motion system and the second X-axis motion system respectively; the Z-axis motion system is slidably matched with the Y-axis motion system; and the moving bracket is arranged between the first bracket and the second bracket.

Furthermore, a first supporting platform is provided on the side of the first bracket towards the second bracket, a second supporting platform is provided on the side of the second bracket towards the first bracket, and the first supporting platform and the second supporting platform are matched for supporting the workbench.

Furthermore, the first X-axis motion system includes: a first X-axis sliding rail mounted on the first bracket, a first X-axis sliding block arranged on the first X-axis sliding rail, and a first X-axis driving device for driving the first X-axis sliding block; the second X-axis motion system includes: a second X-axis sliding rail mounted on the second bracket, a second X-axis sliding block arranged on the second X-axis sliding rail, and a second X-axis driving device for driving the second X-axis sliding block, and the first X-axis driving device and the second X-axis driving device move synchronously; the Y-axis motion system includes: a Y-axis sliding rail, a Y-axis sliding block arranged on the Y-axis sliding rail, and a Y-axis driving device for driving the Y-axis sliding block, and both ends of the Y-axis sliding rail are connected with the first X-axis sliding block and the second X-axis sliding block respectively; and the Z-axis motion system includes: a Z-axis sliding rail, a Z-axis sliding block arranged on the Z-axis sliding rail, and a Z-axis driving device for driving the Z-axis sliding block, and the Z-axis sliding block is connected with the Y-axis sliding block.

Furthermore, the multi-axis motion system is a five-axis motion system, the five-axis motion system further includes: a C-axis motion system mounted on the lower part of the Z-axis sliding rail includes: a C-axis rotating element and a C-axis driving device for driving the C-axis rotating element to rotate, and an A-axis motion system mounted on the C-axis rotating element includes: an A-axis rotating shaft and an A-axis driving device for driving the A-axis rotating shaft to rotate; and the containerless casting forming machine further includes a cutter system which is connected with the A-axis rotating shaft via a rotating flange.

Furthermore, each of the first X-axis sliding rail and the second X-axis sliding rail is provided with a pressing block, each of the first second bracket and the second bracket is provided with a backing board, and the pressing block is connected with the backing board via a fastening bolt.

Furthermore, the moving platform system further includes a guide rail parallel to the X axis; and the moving bracket is provided with a plurality of roller wheels matched with the guide rail.

Furthermore, the lifting device is a cylinder arranged on the moving bracket.

Furthermore, the containerless casting forming machine further includes a machine tool shield covered outside the multi-axis motion system, the first bracket and the second bracket, and the machine tool shield is provided with a front door and/or a rear door for the workbench to pass in and out of the machining range of the multi-axis motion system.

Furthermore, each of the first bracket and the second bracket is provided with a sand shakeout chute with contracting shape.

Furthermore, each of the first supporting platform and the second supporting platform is provided with a locating pin, and the workbench is provided with locating holes matched with the locating pins.

Furthermore, the first bracket and the second bracket are connected via a transverse connecting rod.

Furthermore, the Y-axis sliding rail is two parallel sliding rails; the Y-axis sliding block includes a sleeve part and two legs protruding from two sides of the sleeve part, and the two legs are slidably matched with the two parallel Y-axis sliding rails; and the Z-axis sliding rail is arranged inside the sleeve part and the Z-axis sliding block is connected with the sleeve part.

Furthermore, the containerless casting forming machine further includes a sand discharge cart movably arranged below the sand shakeout chute.

According to the technical scheme of the disclosure, the moving platform system is arranged below the workbench and includes the moving bracket reciprocating along the direction parallel to the X axis, and the lifting device, which is used for lifting and supporting the workbench to enable the linkage between the workbench and the moving bracket, is provided on the moving bracket. Therefore, after the sand blank on the workbench has been machined, the moving platform system is operated, and the lifting device lifts the workbench up and then move the workbench along the X axis, for example, to move the workbench out of the cutting range of the multi-axis motion system so as to remove the machined sand blank or place the sand blank to be machined, and then to move the workbench into the cutting range of the multi-axis motion system along the X axis so as to resume the to-be-machined state or machine the sand blank, so that the moving process of workbench is convenient, simple and easy to be operated.

In addition, according to the technical scheme of the disclosure, the multi-axis motion system can adopt the five-axis motion system to add two freedoms of rotating and swinging for the cutter system, so that the containerless casting forming machine can machine the casting mold of the casting with a large machining size and a complex cavity curved surface, and solves the problem that the containerless casting forming machine in the prior art cannot machine the casting mold of the large complex casting, which has large size structure, complex curved surface of casting mold cavity and a difficult process.

BRIEF DESCRIPTION OF THE DRAWINGS

The drawings here, which constitute one part of the disclosure, are to provide further understanding of the disclosure, and the exemplary embodiments of the disclosure and the explanations thereof are intended to explain the disclosure, instead of improperly limiting the disclosure. In the drawings.

DETAILED DESCRIPTION OF THE EMBODIMENTS

Figure 1:
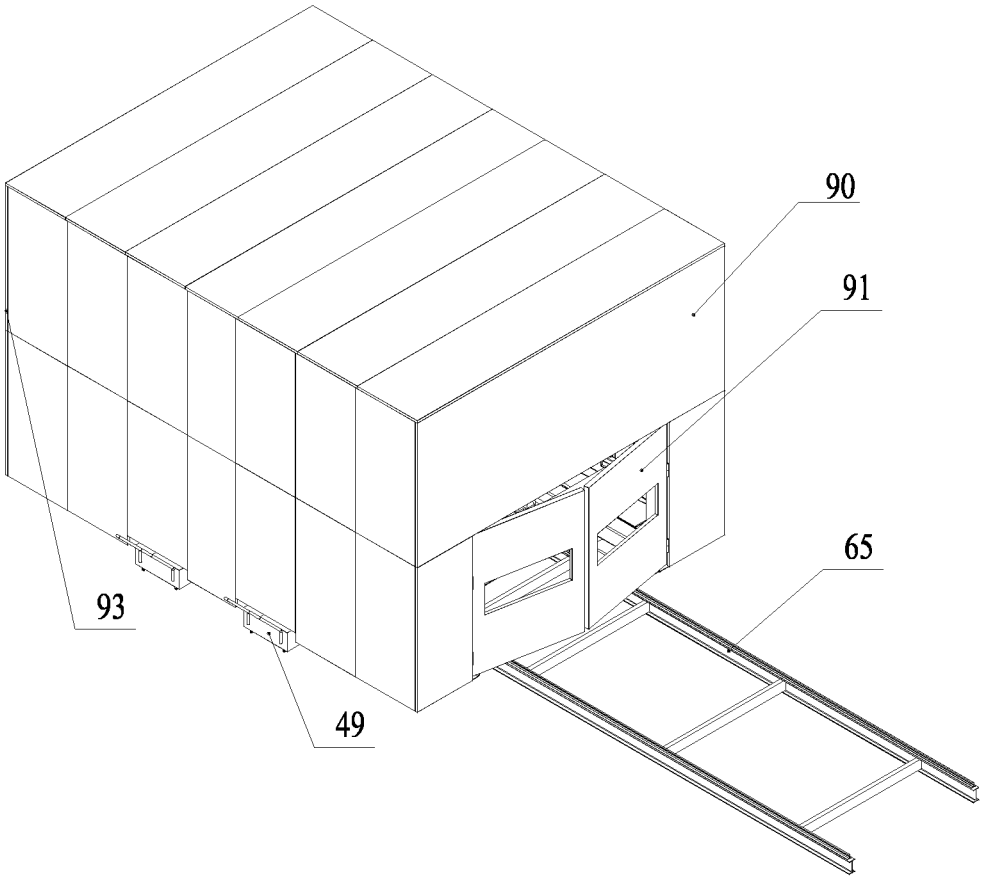
FIG. 1 shows schematically the structure of a containerless casting forming machine of the disclosure.
Figure 2:
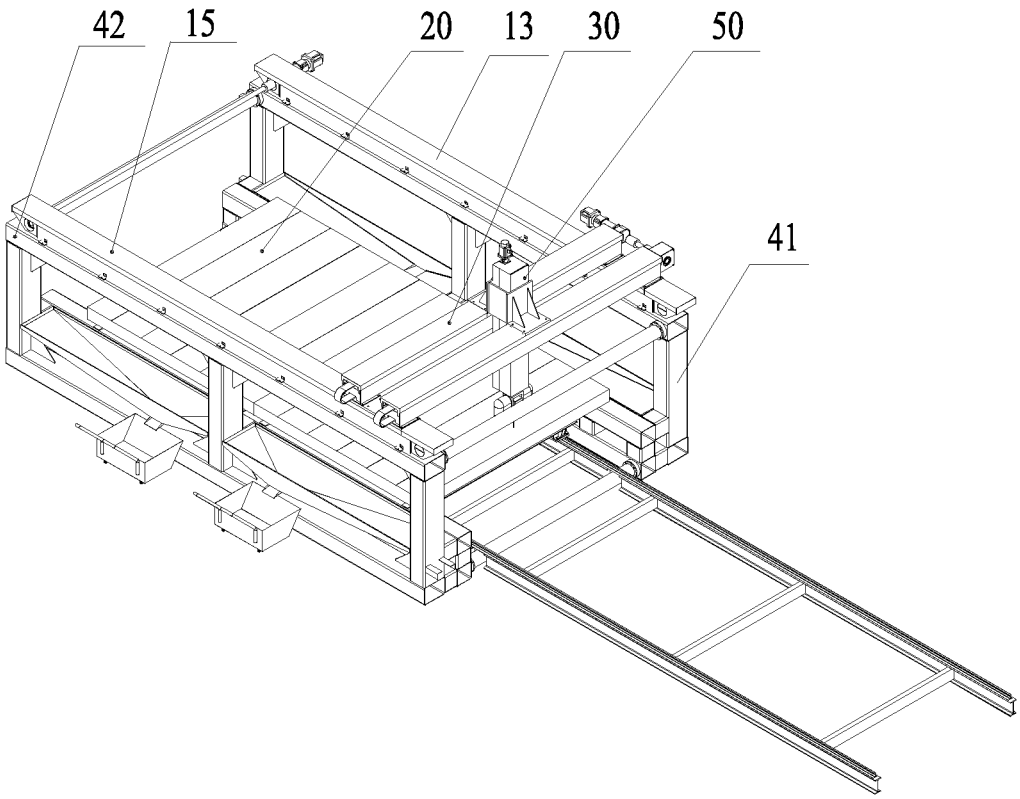
FIG. 2 shows schematically the structures of a multi-axis motion system, a first bracket, a second bracket and a moving platform system in the containerless casting forming machine of the disclosure.

The embodiments of the disclosure are described below in detail in conjunction with the drawings, but the disclosure can be implemented by various different ways limited and covered by the claims.

FIGS. 1 to 11 show schematically a preferred embodiment of a containerless casting forming machine provided by the disclosure, as shown, the containerless casting forming machine includes a multi-axis motion system, a cutter system 200, a workbench 20 and a moving platform system 60.

The multi-axis motion system is used for mounting a machining cutter provided by the cutter system 200. By the operation of the multi-axis motion system, the cutting movement of the machining cutter is controlled, so the sand blank on the workbench 20 is manufactured into a sand mold. The multi-axis motion system may be a three-axis motion system or a five-axis motion system. As shown in the drawings, in the preferred embodiment, the multi-axis motion system takes the five-axis motion system for example, which includes an X-axis motion system 10, a Y-axis motion system 30, a Z-axis motion system 50, a C-axis motion system 71 and an A-axis motion system 72.

Preferably, the X-axis motion system 10 includes a first X-axis motion system 13 and a second X-axis motion system 15 which are parallel to each other. The first X-axis motion system 13 is supported by a first bracket 41, and the second X-axis motion system 15 is supported by a second bracket 42. There is a predetermined distance between the first bracket 41 and the second bracket 42. The distance between the first bracket 41 and the second bracket 42 is determined by the width of the workbench 20. The distance between the first bracket 41 and the second bracket 42 may be set into a larger distance, correspondingly the workbench 20 should be enlarged so as to adapt for the machining space required by a large casting mold. Both ends of the Y-axis motion system 30 are slidably matched with the first motion system 13 and the second X-axis motion system 15 respectively. The Z-axis motion system 50 is slidably matched with the Y-axis motion system 30.

Figure 6:
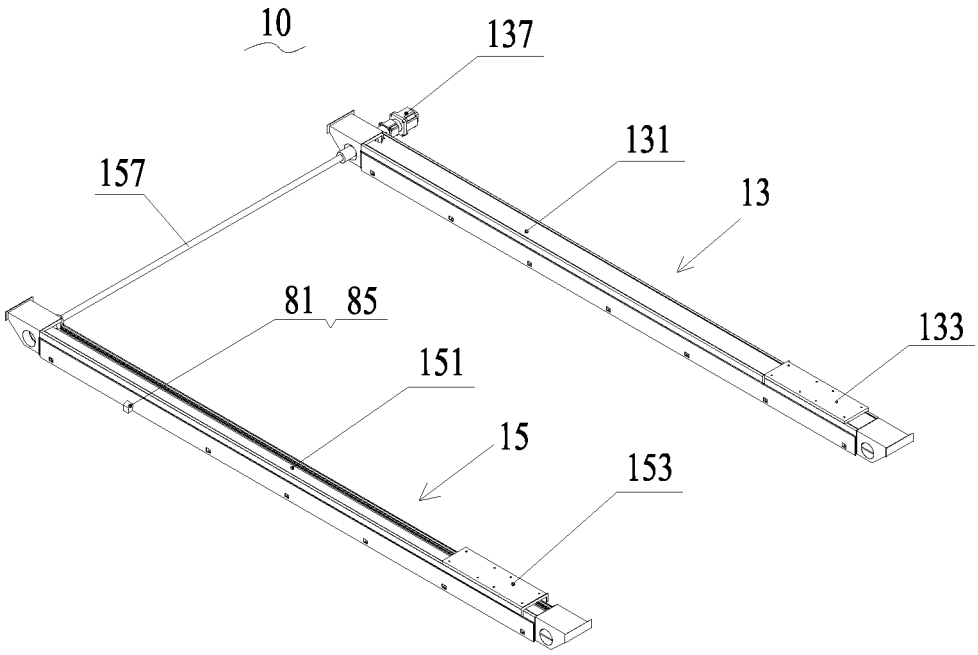
FIG. 6 shows schematically the structure of an X-axis motion system in the containerless casting forming machine of the disclosure.

Specifically, in FIG. 6, the first X-axis motion system 13 includes: a first X-axis sliding rail 131 mounted on the first bracket 41, a first X-axis sliding block 133 arranged on the first X-axis sliding rail 131, and a first X-axis driving device 137 for driving the first X-axis sliding block 133, for example, taking a servo motor and a reducer, which are connected with each other, as a power unit, and taking a motor driven synchronous pulley or a motor driven lead screw as a transmission unit to achieve the effect of driving the first X-axis sliding block 133 to move along the first X-axis sliding rail 131. The second X-axis motion system 15 includes a second X-axis sliding rail 151 mounted on the second bracket 42, a second X-axis sliding block 153 arranged on the second X-axis sliding rail 151, and a second X-axis driving device for driving the second X-axis sliding block 153. The first X-axis driving device and the second X-axis driving device move synchronously. Preferably, the second driving device may adopt the same structure as that of the first X-axis driving device, or as shown in FIG. 6, the first driving device and the second driving device share a servo motor and reducer as the power unit, and then drive the belt pulley or the lead screw of each sliding block by a drive rod 157, thus the sliding block 133 and sliding block 153 move synchronously and the cost of the X-axis motion system is reduced.

Figure 11:
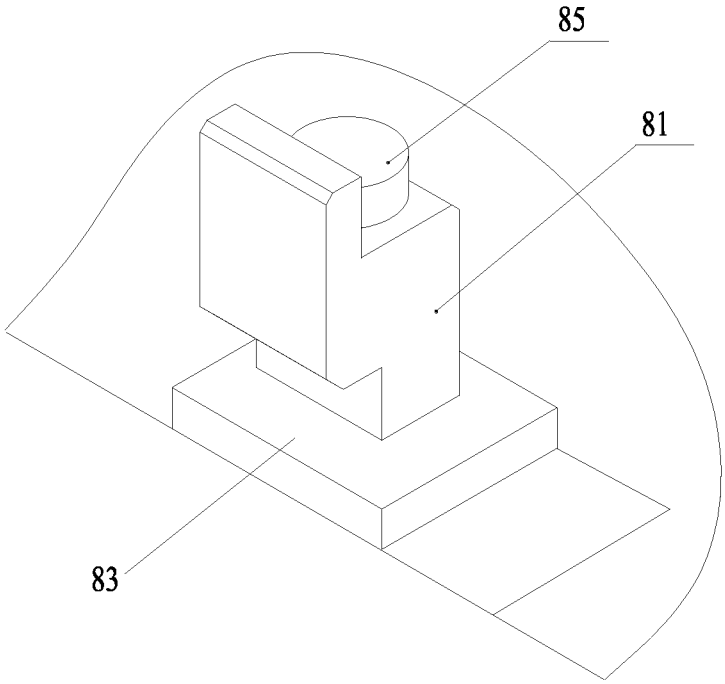
FIG. 11 shows schematically a connection structure between the X-axis motion system and the first bracket or the second bracket in the containerless casting forming machine of the disclosure.

Preferably, in FIG. 11, each of the first X-axis sliding rail 131 and the second X-axis sliding rail 151 is provided with a pressing block 81, each of the first bracket 41 and the second bracket 42 is provided with a backing board 83, and the pressing block 81 is connected with the backing board 83 by a fastening bolt 85, so that the first X-axis sliding rail 131 and the first bracket 41 are connected stably, and the second X-axis sliding rail 151 and the second bracket 42 are connected stably.

Figure 7:
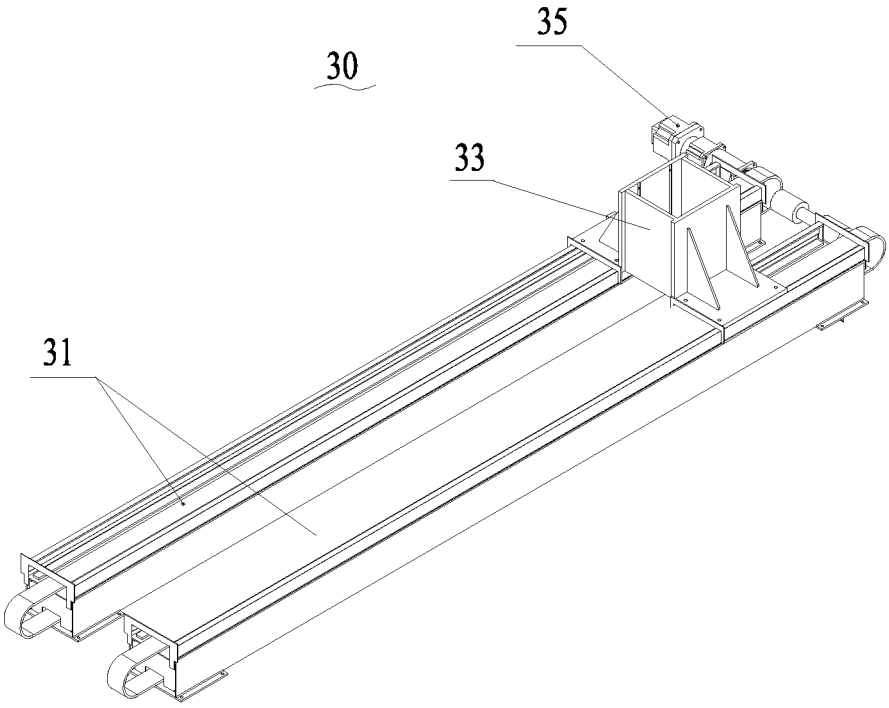
FIG. 7 shows schematically the structure of a Y-axis motion system in the containerless casting forming machine of the disclosure.
Figure 8:
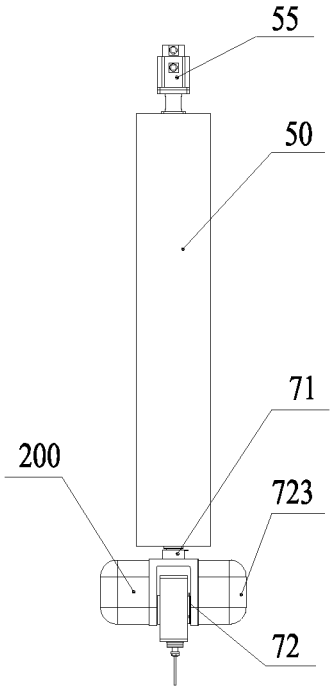
FIG. 8 shows schematically the structure of a Z-axis motion system in the containerless casting forming machine of the disclosure.
Figure 9:
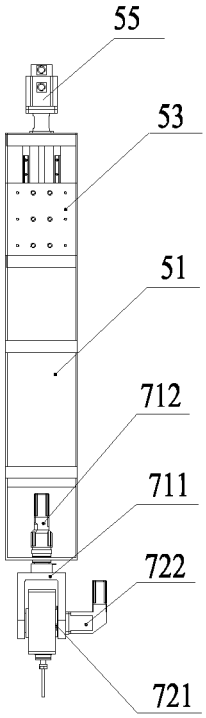
FIG. 9 shows schematically the structures of a Z-axis motion system, a C-axis motion system and an A-axis motion system in the containerless casting forming machine of the disclosure.

In FIGS. 7, 8, and 9, in the embodiment, the Y-axis motion system 30 includes: a Y-axis sliding rail 31, a Y-axis sliding block 33 arranged on the Y-axis sliding rail 31, and a Y-axis driving device 35 for driving the Y-axis sliding block. Both ends of the Y-axis sliding rail 31 are connected with the first sliding block 133 and the second X-axis sliding block 153 respectively (for example, by a connecting plate and a bolt), so that the Y-axis sliding rail 31 can move along the X axis. The Z-axis motion system 50 includes: a Z-axis sliding rail 51, a Z-axis sliding block 53 arranged on the Z-axis sliding rail 51, and a Z-axis driving device 55 for driving the Z-axis sliding block 53. The Z-axis sliding block 53 is connected with the Y-axis sliding block 33, so that the Z-axis sliding rail 51 can slide along either the Y axis or the Z axis.

In the same way, the Y-axis driving device 35 and the Z-axis driving device 55 can take a servo motor and a reducer, which are connected, as a power unit, and take a motor driven synchronous pulley or a motor driven lead screw as a transmission unit to achieve the effect of moving the Y-axis sliding block 33 along the Y-axis sliding rail 31, and moving the Z-axis sliding block 53 along the Z-axis sliding rail 51. Preferably, the Y-axis sliding rail 31 is two parallel sliding rails, and the Y-axis sliding block 33 includes a sleeve part and two legs protruding from two sides of the sleeve part. The Z-axis sliding rail 51 is arranged inside the sleeve part, and the Z-axis sliding block 53 is connected with the sleeve part; and the two legs are slidably matched with the two parallel Y-axis sliding rails respectively, therefore, the Z-axis sliding rail 51 can move more stably.

Preferably, each of the X-axis sliding rail (including the first X-axis sliding rail 131 and the second X-axis sliding rail 151), the Y-axis sliding rail 31 and the Z-axis sliding rail 51 is provided with a shield outside to prevent sand and dust from falling into each sliding rail and affecting the machining precision.

In FIGS. 8 and 9, in the embodiment, the C-axis motion system 71 is mounted on the lower part of the Z-axis sliding rail 51, and includes: a C-axis rotating element 711 and a C-axis driving device 712 for driving the C-axis rotating element 711 to rotate. The C-axis driving device may be a servo motor and a reducer, the C-axis rotating element 711 driven by the servo motor and the reducer can rotate 360 degrees, and the rotating axis of the C-axis rotating element 711 is parallel to the Z axis in the embodiment.

The A-axis motion system 72 is mounted on the C-axis rotating element 711, and includes: an A-axis rotating shaft and an A-axis driving device 722 for driving the A-axis rotating shaft to rotate. The A-axis driving device may be a servo motor and a reducer, the output shaft of the reducer forms the A-axis rotating shaft, and the cutter system 200 of the containerless casting forming machine is directly connected with the A-axis rotating shaft by a rotating flange 721. The cutter system 200 is fixed on the C-axis rotating element 711 by the rotating flange 721, so that the whole cutter system 200 can be driven by the A-axis servo motor and the A-axis reducer to swing around the A-axis rotating shaft, wherein the range of the swinging angle is generally set to be 115 degrees, but the range of the swinging angle is 90 degrees in the practical work. In the embodiment, the axial direction of the A-axis rotating shaft is parallel to the Y axis. Also as shown in the drawings, a shield 723 is arranged outside the A-axis driving device 722.

Figure 10:
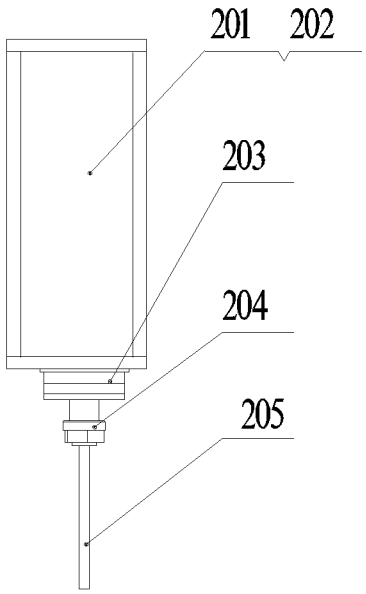
FIG. 10 shows schematically the structure of a cutter system in the containerless casting forming machine of the disclosure.

FIG. 10 shows a preferred embodiment of the cutter system, the cutter system 200 includes: an electric spindle mounting base 201, an electric spindle 202, a rotor 203, a chuck 204, a cutter 205 and other components. The electric spindle mounting base 201 is fixed on the C-axis rotating element 711 by the rotating flange 721 and is driven by the A-axis rotating shaft to swing along the A axis. The electric spindle 202 is fixed on the electric spindle mounting base 201 via a bolt, the rotor 203 is mounted on the electric spindle 202 via a bearing, the chuck 204 is fixed on the rotor 203, and the cutter 205 is fixed on the chuck 204.

In the above-mentioned five-axis motion system, the X-axis motion system 10, Y-axis motion system 30 and Z-axis motion system 50 provide the cutter system 200 with the degree of movement freedom in the directions of X axis, Y axis and Z axis respectively, the C-axis motion system 71 allows the cutter system 200 to rotate 360 degrees around the Z axis, and the A-axis motion system 72 allows the cutter system to swing back and forth, so that the cutter system 200 can machine a complex casting mold cavity curved surface, is particularly suitable for the mold casting of the large complex casting, and can obtain a casting mold with a relatively precise cavity by directly cutting the sand mold and quickly obtain a large complex casting by metal casting without manufacturing a die in advance; therefore, the existing common problems in the casting mold machining process, such as the large complex casting has a large structure size, a complex casting mold cavity curved surface and a difficult process, are solved, and human and material resources for the subsequent machining are saved.

The workbench 20 is below the multi-axis motion system for supporting the sand blank to be machined. The size of the workbench 20 can be set to 5 m×3 m×1 m by adjusting the lengths of the first bracket 41 and the second bracket 42, and the distance between the first bracket 41 and the second bracket 42, in order to provide a machining area large enough to meet the machining requirement of a large casting mold. The workbench 20 is stably supported below the multi-axis motion system in the machining process.

Figure 4:
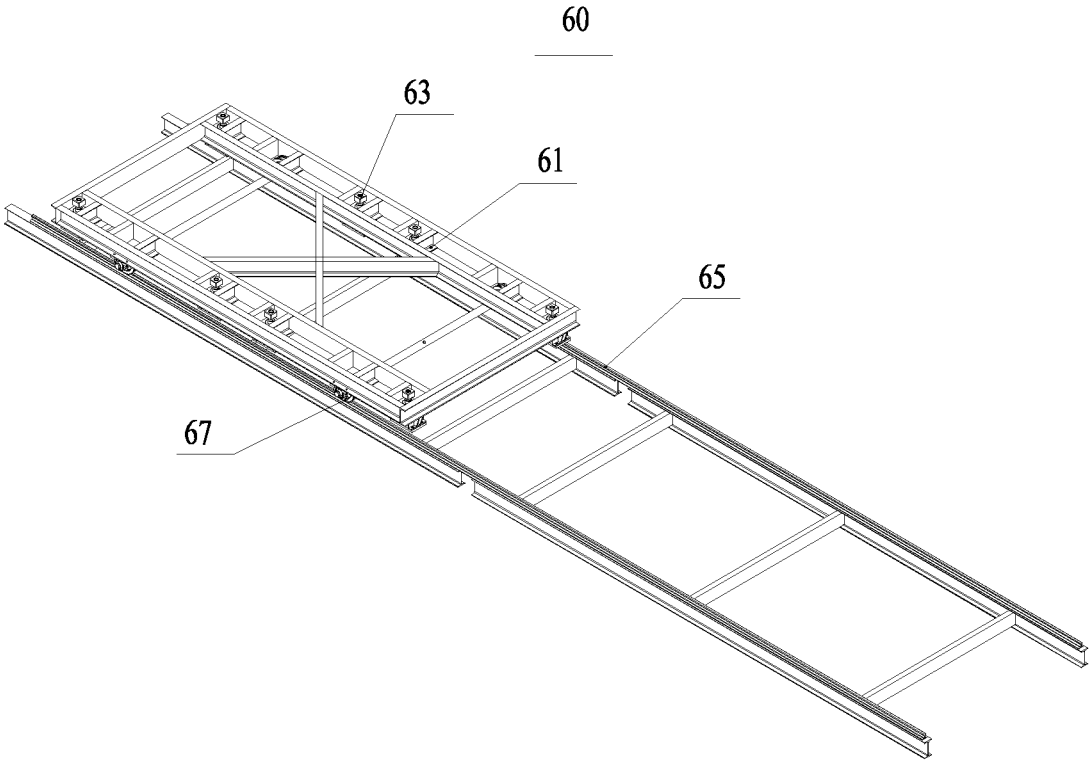
FIG. 4 shows schematically the structure of a moving platform system in the containerless casting forming machine of the disclosure.
Figure 5:
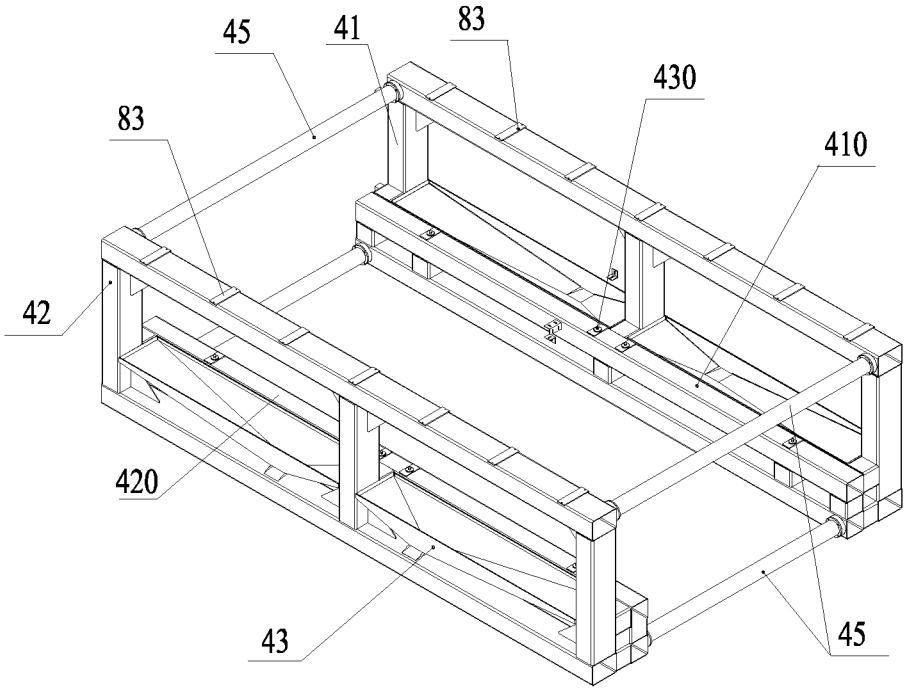
FIG. 5 shows schematically the structures of a first bracket and a second bracket in the containerless casting forming machine of the disclosure.

FIG. 4 shows a preferred embodiment of the moving platform system 60. The moving platform system 60 is below the workbench 20, and includes a guide rail 65, a moving bracket 61 and a lifting device 63. The guide rail 65 is parallel to the X axis, and between the first bracket 41 and the second bracket 42. As shown, the guide rail 65 is laid on an I-beam. The moving bracket 61 is formed by welding various channel steels together, bearing blocks are provided on the moving bracket 61, and a plurality of roller wheels 67 are mounted inside the bearing blocks via bearings. The roller wheels 67 are matched with the guide rail 65, so that the moving bracket 61 can reciprocate along the direction parallel to the X axis. The lifting device 63 for lifting and supporting the workbench 20 is arranged on the moving bracket 61 to enable the linkage between the workbench 20 and the moving bracket 61. Preferably, the lifting device 63 is a cylinder arranged on the moving bracket 61. Of course, the moving platform system 60 can also adopt other implementing ways only if the moving bracket 61 can be moved along the X axis.

Preferably, a first supporting platform 410 is provided on the side of the first bracket 41 towards the second bracket 42, and a second supporting platform 420 is provided on the side of the second bracket 42 towards the first bracket 41. When the workbench 20 is in the machining state, the workbench 20 is supported by the cooperation of the first supporting platform 410 and the second supporting platform 420. In order to locate the workbench conveniently, each of the first supporting platform 410 and the second supporting platform 420 is provided with a locating pin 430, and the workbench is provided with locating holes matched with the locating pins 430.

Preferably, as shown, the first bracket 41 and the second bracket 42 are connected via a transverse connecting rod 45, and a stiffener board is welded between the main beam and the upright beam of the first bracket 41 and the second bracket 42 to reinforce the structure strength of the first bracket 41 and the second bracket 42.

Because of the moving platform system 60, the workbench 20 can be moved out by the moving bracket 61 when the workbench 20 is not in the machining state, so that the workbench 20 can be moved to the required position conveniently without a lifting tool, and the sand blank can be placed on the workbench 20 or the machined sand mold can be removed conveniently.

Figure 3:
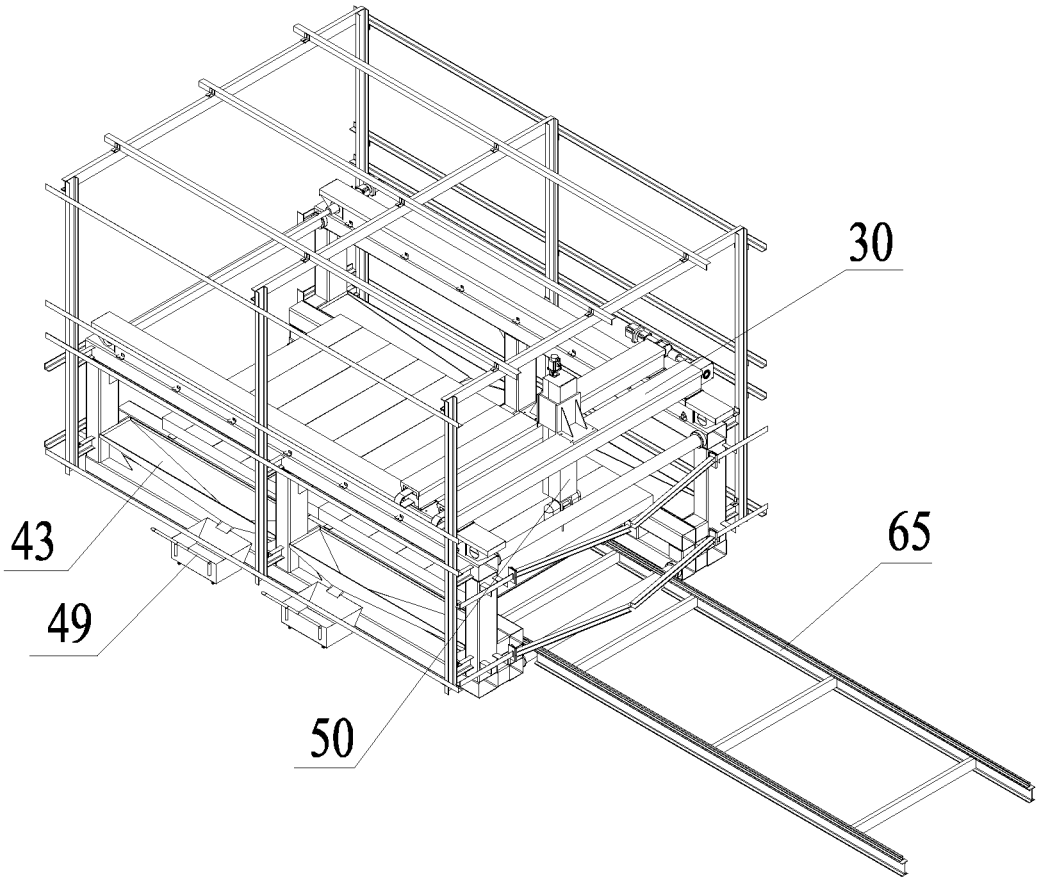
FIG. 3 shows schematically the structures of a multi-axis motion system, a first bracket, a second bracket, a moving platform system and a machine tool shield in the containerless casting forming machine of the disclosure.

See FIGS. 1 and 3, preferably, the containerless casting forming machine further includes a machine tool shield 90 covered outside the multi-axis motion system, the first bracket 41 and the second bracket 42, and the machine tool shield 90 is provided with a front door 91 and/or a rear door 93 for the workbench 20 to pass in and out of the machining range of the multi-axis motion system. Because of the machine tool shield 90, the problems of serious exhaust and dust pollution and severe working environment in the workshop in the machining process of the casting mold numerical control forming machine are solved. Preferably, the machine tool shield 90 is formed by welding a plurality of stainless steel plates, angle steels and channel steels together, and the machine tool shield 90 is welded and fixed on the first bracket 41 and the second bracket 42 via a cross beam of shield, an upright beam of shield and a side beam of shield. The front door and the rear door are mounted on the first bracket 41 and the second bracket 42 by a fixing beam of door, a cross beam of door and a hinge respectively.

Furthermore, both the first bracket 41 and the second bracket 42 are provided with sand shakeout chutes 43 with contracting shape. In the embodiment, the number of the sand shakeout chutes 43 is four. A movable sand discharge cart 49 is further arranged below the sand shakeout chute 43, and used for accepting the cut waste sand and then conveying the waste sand away to clean the working environment.

The machining flow of the containerless casting forming machine of the disclosure is briefly described below.

1. The workbench 20 is outside the multi-axis motion system and is supported by the cylinder, the sand blank to be machined is placed on the workbench 20, and then the moving bracket 61 is controlled to move along the X axis into the inside of the machine tool shield 90;

2. The cylinder retracts, the locating holes of the workbench 20 are matched with the locating pins 430 on the first supporting platform 410 and the second supporting platform 420 to ensure that the workbench 20 is positioned precisely. The cutter system mounted on the multi-axis motion system can cut the sand blank on the workbench 20, and the cut sand drops into the sand discharge cart 49 through the sand shakeout chute 43; and 3. After the sand blank is machined by the multi-axis motion system, the workbench 20 is lifted up by the cylinder, and then, the moving bracket 61 moves the workbench 20 to the outside of the machine tool shield 90, thus the machined casting mold could be removed.

To sum up, the disclosure has the following advantages: the workbench is convenient to be moved and dispenses with the lifting tool; the plane size of the workbench is large enough, and the effective stroke of each motion system is large enough, the precision is relatively higher, and human and material resources for the subsequent machining are saved; and the design of the five-axis motion system has a large machining space, and can machine a complex curved surface and obtain the casting mold of the large complex casting.

The above are only preferred embodiments of the disclosure and not intended to limit the disclosure. For those skilled in the art, the disclosure may have various modifications and changes. Any modifications, equivalent replacements, improvements and the like within the spirit and principle of the disclosure shall fall within the scope of protection of the disclosure.

What is claimed is:

1. A containerless casting forming machine comprising:

a multi-axis motion system, which at least comprises an X-axis motion system (10), a Y-axis motion system (30) and a Z-axis motion system (50), and a workbench (20), which is below the multi-axis motion system, wherein the containerless casting forming machine further comprises:

a moving platform system (60) below the workbench (20), comprising a moving bracket (61) which can reciprocate along the direction parallel to the X axis and a lifting device (63) provided on the moving bracket (61), which is used for lifting and supporting the workbench (20) to enable the linkage between the workbench (20) and the moving bracket (61);

the X-axis motion system (10) comprises a first X-axis motion system (13) and a second X-axis motion system (15) which are parallel to each other; the first X-axis motion system (13) is supported by a first bracket (41), the second X-axis motion system (15) is supported by a second bracket (42), and there is a predetermined distance between the first bracket (41) and the second bracket (42);

both ends of the Y-axis motion system (30) are slidably matched with the first X-axis motion system (13) and the second X-axis motion system (15) respectively;

the Z-axis motion system (50) is slidably matched with the Y-axis motion system (30); and the moving bracket (61) is arranged between the first bracket (41) and the second bracket (42);

a first supporting platform (410) is provided on the side of the first bracket (41) towards the second bracket (42), a second supporting platform (420) is provided on the side of the second bracket (42) towards the first bracket (41), and the first supporting platform (410) and the second supporting platform (420) are matched for supporting the workbench (20);

each of the first supporting platform (410) and the second supporting platform (420) is provided with a locating pin (430), and the workbench (20) is provided with locating holes matched with the locating pins (430).

2. The containerless casting forming machine according to claim 1, wherein the first X-axis motion system (13) comprises: a first X-axis sliding rail (131) mounted on the first bracket (41), a first X-axis sliding block (133) arranged on the first X-axis sliding rail (131), and a first X-axis driving device (137) for driving the first X-axis sliding block (133);

the second X-axis motion system (15) comprises: a second X-axis sliding rail (151) mounted on the second bracket (42), a second X-axis sliding block (153) arranged on the second X-axis sliding rail (151), and a second X-axis driving device for driving the second X-axis sliding block (153), and the first X-axis driving device and the second X-axis driving device move synchronously;

the Y-axis motion system (30) comprises: a Y-axis sliding rail (31), a Y-axis sliding block (33) arranged on the Y-axis sliding rail (31), and a Y-axis driving device (35) for driving the Y-axis sliding block (33), and both ends of the Y-axis sliding rail (31) are connected with the first X-axis sliding block (133) and the second X-axis sliding block (153) respectively; and the Z-axis motion system (50) comprises: a Z-axis sliding rail (51), a Z-axis sliding block (53) arranged on the Z-axis sliding rail (51), and a Z-axis driving device (55) for driving the Z-axis sliding block, and the Z-axis sliding block (53) is connected with the Y-axis sliding block (33).

3. The containerless casting forming machine according to claim 2, wherein the multi-axis motion system is a five-axis motion system, the five-axis motion system further comprises:

a C-axis motion system (71) mounted on the lower part of the Z-axis sliding rail comprises: a C-axis rotating element (711) and a C-axis driving device (712) for driving the C-axis rotating element (711) to rotate, and an A-axis motion system (72) mounted on the C-axis rotating element (711) comprises: an A-axis rotating shaft and an A-axis driving device (722) for driving the A-axis rotating shaft to rotate; and the containerless casting forming machine further comprises a cutter system (200) which is connected with the A-axis rotating shaft via a rotating flange (721).

4. The containerless casting forming machine according to claim 2, wherein each of the first X-axis sliding rail (131) and the second X-axis sliding rail (151) is provided with a pressing block (81), each of the first second bracket (41) and the second bracket (42) is provided with a backing board (83), and the pressing block (81) is connected with the backing board (83) via a fastening bolt (85).

5. The containerless casting forming machine according to claim 1, wherein the moving platform system (60) further comprises a guide rail (65) parallel to the X axis; and the moving bracket (61) is provided with a plurality of roller wheels (67) matched with the guide rail (65).

6. The containerless casting forming machine according to claim 5, the lifting device (63) is a cylinder arranged on the moving bracket (61).

7. The containerless casting forming machine according to claim 1, further comprising a machine tool shield (90) covered outside the multi-axis motion system, the first bracket (41) and the second bracket (42), and the machine tool shield is provided with a front door (91) and/or a rear door (93) for the workbench (20) to pass in and out of the machining range of the multi-axis motion system.

8. The containerless casting forming machine according to claim 1, wherein each of the first bracket (41) and the second bracket (42) is provided with a sand shakeout chute (43) with contracting shape.

9. The containerless casting forming machine according to claim 1, wherein the first bracket (41) and the second bracket (42) are connected via a transverse connecting rod (45).

10. The containerless casting forming machine according to claim 2, wherein the Y-axis sliding rail (31) is two parallel sliding rails; the Y-axis sliding block (33) comprises a sleeve part and two legs protruding from two sides of the sleeve part, and the two legs are slidably matched with the two parallel Y-axis sliding rails; and the Z-axis sliding rail (51) is arranged inside the sleeve part and the Z-axis sliding block is connected with the sleeve part.

11. The containerless casting forming machine according to claim 8, further comprising a sand discharge cart (49) movably arranged below the sand shakeout chute (43).

* * * * *